US006606951B1

(12) United States Patent
Klein

(10) Patent No.: US 6,606,951 B1
(45) Date of Patent: Aug. 19, 2003

(54) BOUNDING ANTI-TANK/ANTI-VEHICLE WEAPON

(75) Inventor: Arnold S. Klein, Rockaway, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/065,676

(22) Filed: Nov. 7, 2002

(51) Int. Cl.[7] ..... F42C 1/00
(52) U.S. Cl. ..... 102/416
(58) Field of Search ..... 102/404, 401, 102/425, 416

(56) References Cited

U.S. PATENT DOCUMENTS 3,868,905 A * 3/1975 Ragailler ..... 102/404
3,921,528 A * 11/1975 Faulstich et al. ..... 102/404
3,994,227 A * 11/1976 Harvey ..... 102/404
4,210,082 A * 7/1980 Brothers ..... 102/401
4,538,519 A * 9/1985 Witt et al. ..... 102/387
4,649,828 A * 3/1987 Henderson et al. ..... 102/476
4,848,236 A * 7/1989 Hembise ..... 102/427
4,860,658 A * 8/1989 Lindstadt et al. ..... 102/427
4,919,051 A * 4/1990 Cohen ..... 102/404
4,922,824 A * 5/1990 Schubart ..... 102/387
4,934,274 A * 6/1990 Mathey ..... 102/401
5,070,786 A * 12/1991 Hartman et al. ..... 102/214
5,142,986 A * 9/1992 Gundel ..... 102/401
5,169,093 A * 12/1992 Schoffl ..... 244/149
5,191,169 A * 3/1993 Hu ..... 102/476
5,245,926 A * 9/1993 Hunter ..... 102/215
5,261,328 A * 11/1993 de la Haye ..... 102/425
5,271,331 A * 12/1993 Miller ..... 102/427
5,279,229 A * 1/1994 Bredy et al. ..... 102/425
5,497,705 A * 3/1996 Bredy et al. ..... 102/427
5,540,156 A * 7/1996 Fong ..... 102/476
5,753,851 A * 5/1998 Jordan et al. ..... 102/427
6,363,854 B1 * 4/2002 Schweitzer ..... 102/401
6,408,763 B1 * 6/2002 Hurtta et al. ..... 102/404
6,487,952 B1 * 12/2002 Borgwarth et al. ..... 89/1.81

* cited by examiner

*Primary Examiner*—Charles T. Jordan
*Assistant Examiner*—Jordon M Lofdahl
(74) *Attorney, Agent, or Firm*—Michael C. Sachs; John F. Moran

(57) ABSTRACT

A bounding anti-armor/anti-vehicle mine attacks and destroys multiple targets simultaneously at the targets" closest point of approach. This is accomplished by utilizing multiple asymmetric explosively forged penetrators (EFPs) on a warhead that is capable of producing multiple armor penetrating kills horizontally in 360 degrees. The warhead comprises, for example, 16 curved copper or non-ferrous EFP metal plates arranged parallel to the central axis of the mine. The warhead is initiated either centrally or from either end, depending on the type of target being attacked.

19 Claims, 5 Drawing Sheets

OPERATIONAL SEQUENCE

BOUNDING ANTI-TANK/ANTI-VEHICLE WEAPON

FEDERAL RESEARCH STATEMENT

[The inventions described herein may be manufactured, used and licensed by or for the U.S. Government for U.S. Government purposes.]

BACKGROUND OF INVENTION

The invention relates in general to munitions and in particular to a bounding anti-tank/anti-vehicle mine.

With the exception of wide area mines, present anti-armor mines do not protect large areas. Wide area mines are comparatively expensive and not very reliable. In addition, present mines, only attack one target per mine. This problem has existed for 50 years. Present wide area mines do not produce catastrophic kills or firepower kills.

The old way to solve the problem was to plant a lot of antitank mines and hope that one of them would encounter a vehicle. This method involved a lot of mines which became a logistics problem and was very man-hour intensive.

SUMMARY OF INVENTION

An important advantage of the present invention is that it can kill multiple armor and vehicle targets in 360 degrees over a wide area with one mine. This is accomplished by the use of a multiple asymmetric explosively forged penetrator (EFP) warhead that is capable of producing multiple armor penetrating kills from a single warhead horizontally in 360 degrees. In addition, the firing train of the warhead can modify the output from the warhead to tailor it to the particular type of target of interest.

The invention will be better understood, and further objects, features, and advantages thereof will become more apparent from the following description of the preferred embodiments, taken in conjunction with the accompanying drawings.

BRIEF DESCRIPTION OF DRAWINGS

In the drawings, which are not necessarily to scale, like or corresponding parts are denoted by like or corresponding reference numerals.

DETAILED DESCRIPTION

Figure 1A:
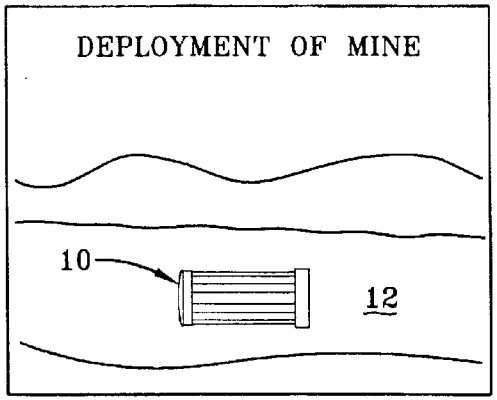
FIGS. 1A–D show the operational sequence of the mine according to the invention.

The present invention is a bounding anti-armor/anti-vehicle mine specifically designed to attack and destroy multiple targets simultaneously at the targets" closest point of approach. This is accomplished by utilizing multiple asymmetric explosively forged penetrators (EFPs) on a warhead that is capable of producing multiple armor penetrating kills horizontally in 360 degrees. The warhead comprises, for example, 16 curved copper or non-ferrous EFP metal plates approximately 1.375"×10" long arranged parallel to the central axis of the mine. The warhead contains, for example, approximately 29 pounds of PAX 3 explosive and is initiated either centrally or from either end, depending on the type of target being attacked.

When the warhead is initiated, the EFP metal plates fold into a clothespin shape that focuses all the energy of the explosive along a horizontal plane perpendicular to the central axis of the mine. This focusing of the explosive energy allows the EFP to punch through many inches of armor. The mine can be command controlled on-off-on with multiple remotely settable self-destruct times. The mine utilizes a three-axis magnetometer and an acoustic sensor to both detect, range gate, and classify a target. The mine waits for the closest point of approach of a given target and classifies the target as either light/medium or heavy. The warhead then bounds in the air three to four feet and detonates in a way that is appropriate for the target's classification. If the target is classified as an armor (i.e., heavy) target, the warhead will bound, detonate at its center and project the clothespin shaped EFP's in 360 degrees horizontally, killing multiple targets within 40 meters of the mine. If the target is classified as light/medium, the warhead will bound, detonate at one of its ends and fragment the EFPs, sending fragments in 360 degrees horizontally.

FIGS. 1A–D show an example of the operational sequence of the mine 10 according to the invention. The bounding anti-armor/anti-vehicle mine 10 may be, for example, deployed by hand, vehicle, air or missile. After impact of mine 10 on the ground 12 (FIG. 1A), erection legs 14 (FIG. 1B) are released. The erection legs 14 erect the mine 10 in a vertical position. A radio command is sent to the mine 10, arming the mine and setting its self-destruct time. Upon magnetic and acoustic detection of a vehicular target 16 (FIG. 1C), the mine 10 waits for the closest point of approach and then, the bounding portion 18 bounds in the air three to four feet. A stationary portion 20 remains on the ground. The warhead then detonates (FIG. 1D) and sprays EFP fragments horizontally in 360 degrees penetrating the targets 16 and destroying them.

Figure 1B:
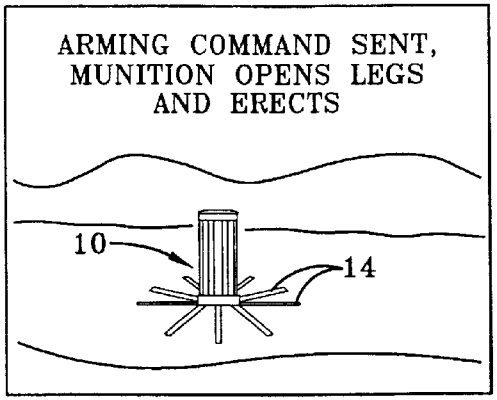
Figure 1C:
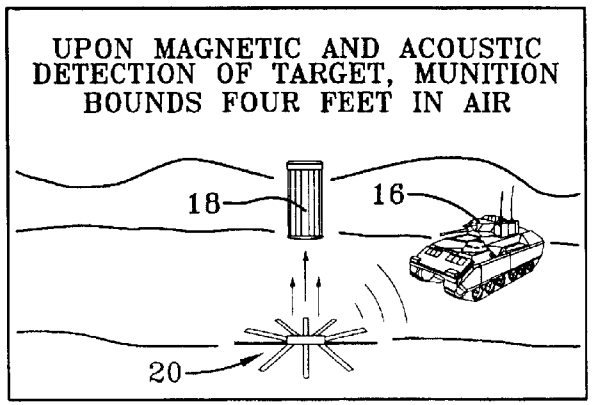
Figure 1D:
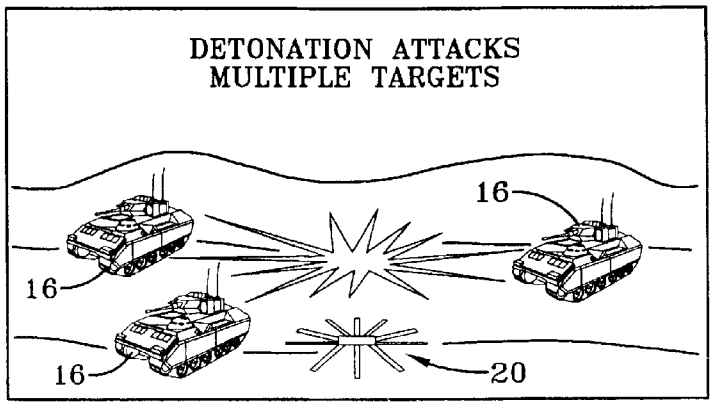
Figure 2C:
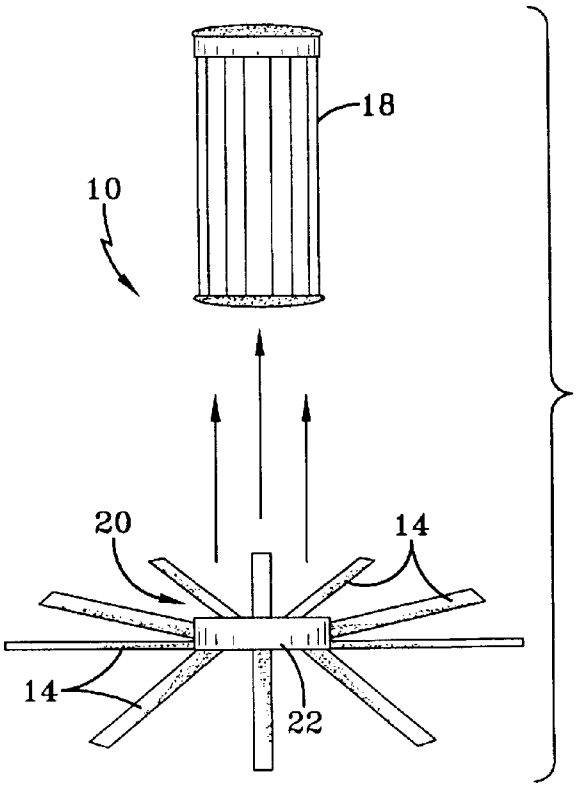
FIG. 2C is a larger view of the mine in the position of FIG. 1C.
Figure 2A:
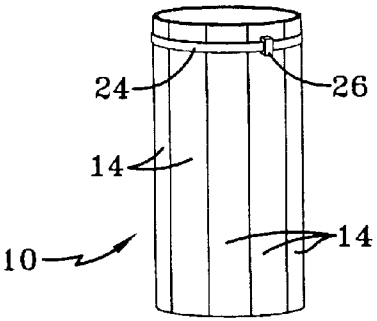
FIG. 2A is a larger view of the mine in the position of FIG. 1A.
Figure 2B:
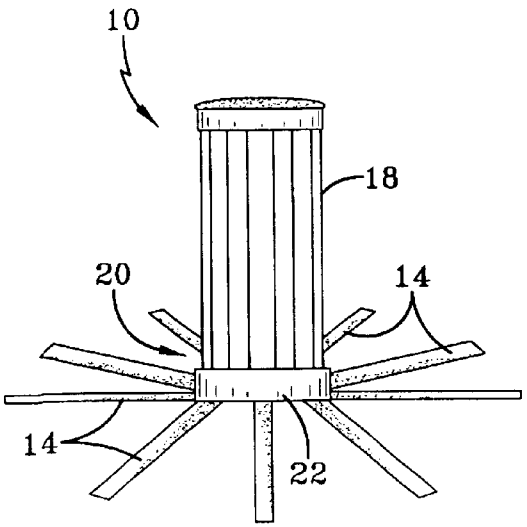
FIG. 2B is a larger view of the mine in the position of FIG. 1B

FIG. 2A is a larger view of the mine 10 in the position of FIG. 1A (except oriented vertically rather than horizontally), FIG. 2B is a larger view of the mine 10 in the position of FIG. 1B, armed and erect, and FIG. 2C is a larger view of the mine 10 in the position of FIG. 1C, bounding and about to detonate. Referring to FIG. 2A, mine 10 includes a band 24 disposed around upper ends of the erection legs 14 for maintaining the erection legs 14 in an upright, folded position. A pyrotechnic band cutter 26 is disposed on the band 24 and electrically connected to the fuze electronics. When mine 10 is deployed, a timer circuit in the fuze electronics starts. When the timer circuit delay ends, the fuze electronics sends a signal to the pyrotechnic band cutter 26. The band cutter 26 then detonates, cutting band 24 and allowing erection legs 14 to unfold, as shown in FIGS. 2B and 2C. Referring to FIGS. 2B and 2C, mine 10 includes a bounding portion 18 and a stationary portion 20. Stationary portion 20 includes erection legs 14 and a cup 22 into which a bottom end of the bounding portion 18 is received.

Figure 3:
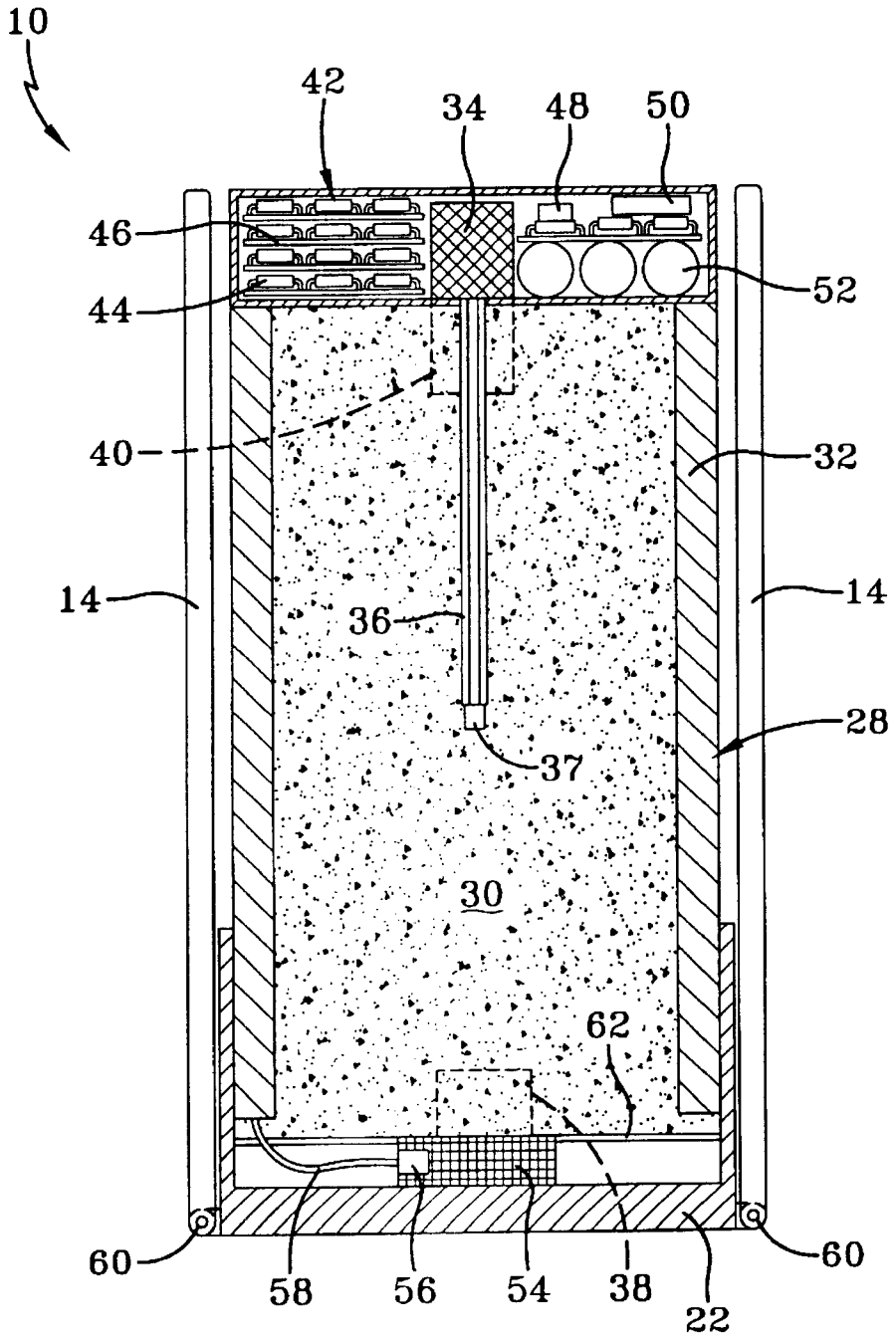
FIG. 3 is a view, partially in cross-section, of one embodiment of a mine according to the invention.

FIG. 3 is a view, partially in cross-section, of one embodiment of a mine 10 according to the invention. The bounding portion 18 includes a warhead 28, a safe and arm device 34, fuze electronics 42, a radio 44, a three-axis magnetometer 48, an acoustic sensor 50 and a power supply 52. The stationary portion 20 includes a cup 22 for receiving a bottom end of the warhead 28, a bounding charge 54 disposed below the bottom end of the warhead 28 and a plurality of erection legs 14 connected to the cup 22.

The bounding charge 54 comprises a propellant igniter 56 electrically connected by, for example, wire 58 to the fuze electronics 42. The bounding charge 54 may be, for example, M5 propellant or black powder. The quantity of bounding charge 54 is on the order of 25 grams, depending on the size of the warhead. A plate 62 is disposed between the bounding charge 54 and the bottom end of the warhead 28. Each erection leg 14 is connected to the cup 22 by a hinge 60 including a torsion spring that tends to force the erection leg 14 away from cup 22.

The warhead 28 comprises a generally cylindrical mass of explosive 30 having a longitudinal axis and a plurality of asymmetric EFPs 32. The EFPs 32 are disposed around the circumference of the mass of explosive 30 and are disposed generally parallel to the longitudinal axis of the mass of explosive 30. The explosive 30 is for example, approximately 29 pounds of PAX 3 explosive. The safe and arm device 34, fuze electronics 42, radio 44, three-axis magnetometer 48, acoustic sensor 50 and power supply 52 are disposed on top of the warhead 28. The power supply 52 is, for example, lithium thional chloride batteries.

The fuze electronics 42 includes a computer 46. The computer 46 is connected to the safe and arm device 34, the radio 44, the three-axis magnetometer 48, the acoustic sensor 50 and the power supply 52. The safe and arm device 34 comprises a fuze cord 36 extending from the top of the warhead 28 along the longitudinal axis of the mass of explosive 30 and terminating at about a longitudinal midpoint of the mass of explosive 30. A detonator 37 is attached to the end of fuze cord 36. The safe and arm device 34 further comprises at least one of a detonator 40, disposed at a top center of the explosive 30, and a detonator 38, disposed at a bottom center of the explosive 30. Detonators 38, 40 are electrically connected to the safe and arm device 34.

Figure 4:
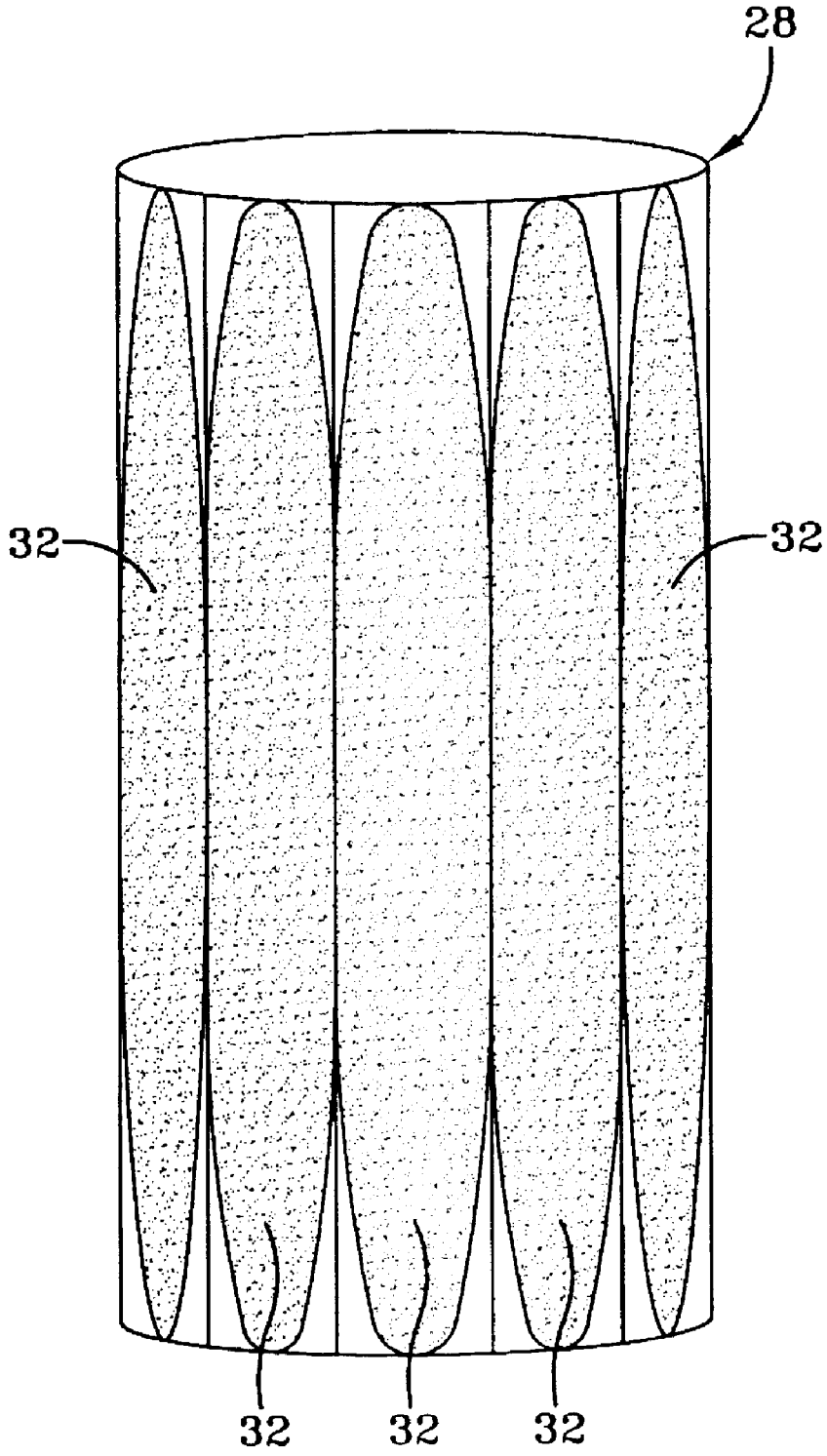
FIG. 4 is a perspective view of an exemplary warhead.
Figure 5:
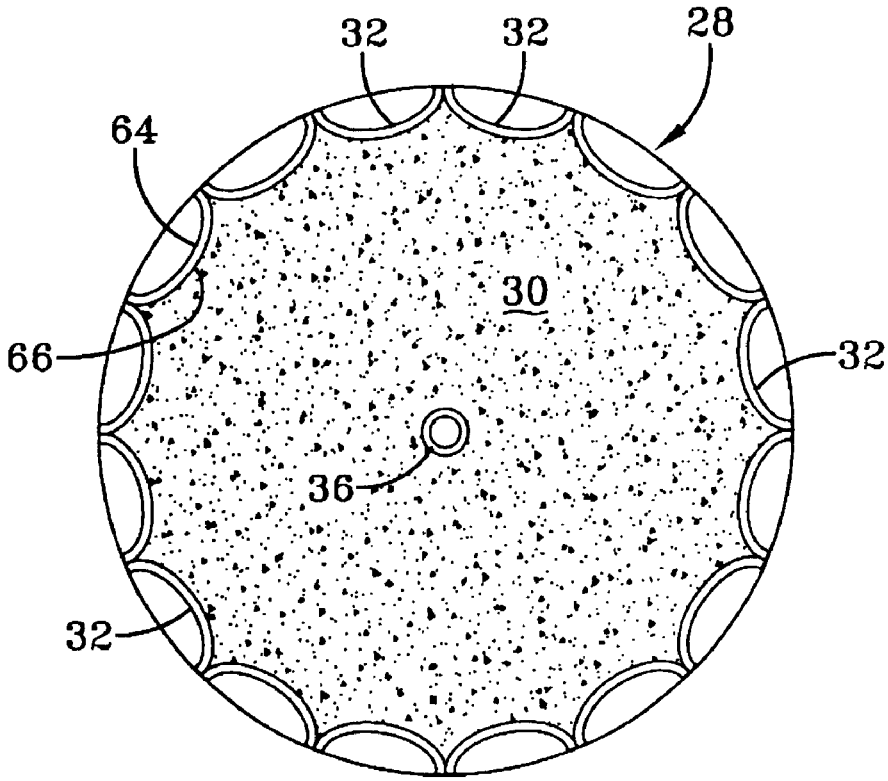
FIG. 5 is a top view of the warhead.

FIG. 4 is a perspective view of an exemplary warhead 28. Each asymmetric EFP 32 has a substantially elliptical shape with a major axis parallel to the longitudinal axis of the mass of explosive 30. FIG. 5 is a top view of the warhead 28. As shown in FIG. 5, each EFP 32 includes a concave outer surface 64 and a convex inner surface 66. In a preferred embodiment, the number of EFPs is sixteen. The EFPs are made of, for example, copper, 302 stainless steel or other suitable metal that will not interfere with the magnetometer 48. The EFPs 32 may be attached directly to formed explosive 30 by, for example, gluing. Alternatively, the EFPs may be pressed.and inscribed in a flat piece of metal. The flat piece of metal is then rolled into a cylindrical shape and place around the explosive 30.

Figure 6:
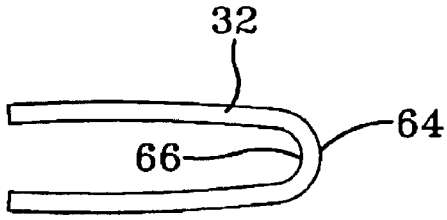
FIG. 6 is a side view of an explosively forged penetrator, after detonation.

If the mine 10 senses that the target is a tracked vehicle (i.e., heavy target), the warhead 48 is detonated using the fuze cord 36. The fuze cord 36 (FIG. 3) initiates detonation from the center of warhead 48. This type of detonation causes the EFPs to fold into a clothespin like shape, as shown in FIG. 6. The explosive will project the clothespin shaped EFP's in 360 degrees horizontally, killing multiple targets within 40 meters of the mine. If the target is classified as a wheeled vehicle (i.e., light/medium target), the warhead will detonate at one of its ends 38, 40 and fragment the EFPs, sending fragments in 360 degrees horizontally.

The computer 46 comprises means for storing acoustic signatures of a variety of target vehicles, both tracked and wheeled. The computer 46 compares the signal received from the acoustic sensor 50 to the stored acoustic signatures, and determines whether a sensed target is tracked (heavy) or wheeled (light/medium). The acoustic sensor 50 is operable in a range of about 100 meters from the mine 10. Simultaneously, the magnetometer 48 indicates whether or not a suitable target is present, based on the iron content of the target. The range of the magnetometer is shorter, about 38 meters. When the magnetometer 48 senses a suitable target in range, and the magnetometer signal strength has just peaked from a maximum, the computer 46 is then prepared to send a detonate signal to the fuze electronics 42. However, the acoustic sensor 50 must also be sensing a suitable target, that is, a tracked or wheeled vehicle.

If both sensors have sensed suitable targets, then the computer 46 sends a detonate signal to the fuze electronics 42. The fuze electronics 42 first sends a detonate signal to the bounding charge 54. The bounding charge 54 detonates, sending the warhead 28 three to four feet into the air. After a short time delay on the order of milliseconds, the fuze electronics 42 sends a detonate signal to the explosive 30. Depending on the target sensed, the detonate signal is sent to the fuze cord 36, or one of the detonators 38, 40 located at the ends of the warhead 28.

If the acoustic sensor 50 has sensed that the target is a tracked vehicle (i.e., heavy target), the warhead 48 is detonated using the fuze cord 36. The fuze cord 36 (FIG. 3) initiates detonation from the center of warhead 48. This type of detonation causes the EFPs to fold into a clothespin like shape, as shown in FIG. 6. The explosive will project the clothespin shaped EFP's in 360 degrees horizontally, killing multiple targets within 40 meters of the mine. If the acoustic sensor 50 has sensed that the target is a wheeled vehicle (i.e., light/medium target), the warhead detonates at one of its ends 38, 40 and fragments the EFPs, sending the fragments in 360 degrees horizontally.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An anti-tank anti-vehicle mine, comprising:

a bounding portion, the bounding portion comprising a warhead, a safe and arm device, fuze electronics, a radio, a three-axis nagnetometer, an acoustic sensor and a power supply;

a stationary portion, the stationary portion comprising a cup for receiving a bottom end of the bounding portion, a bounding charge disposed below the bottom end of the bounding portion and a plurality of erection legs connected to the cup;

wherein the said warhead comprises a generally cylindrical mass of explosive having a longitudinal axis and a plurality of asymmetric explosively forged penetrators disposed around a circumference of the mass of explosive and generally parallel to the longitudinal axis of the mass of explosive.

2. The mine of claim 1 wherein each erection leg is connected to the cup by a hinge having a torsion spring that tends to force the erection leg away from cup.

3. The mine of claim 2 wherein the safe and arm device, fuze electronics, radio, three-axis magnetometer, acoustic sensor and power supply are disposed on a top of the warhead.

4. The mine of claim 3 wherein the fuze electronics include a computer, the computer being connected to the safe and arm device, the radio, the three-axis magnetometer, the acoustic sensor and the power supply.

5. The mine of claim 4 wherein the safe and arm device comprises a fuze cord extending from the top of the warhead along the longitudinal axis of the mass of explosive and terminating at about a longitudinal midpoint of the mass of explosive.

6. The mine of claim 5 wherein the bounding charge comprises a propellant igniter electrically connected to the fuze electronics.

7. The mine of claim 6 wherein the erection legs are held in an unfolded position by a band disposed around upper ends of the erection legs, the mine further comprising a pyrotechnic band cutter disposed on the band and electrically connected to the fuze electronics.

8. The mine of claim 7 further comprising a plate disposed between the bounding charge and a bottom end of the warhead.

9. The mine of claim 8 wherein each asymmetric explosively forged penetrator has a substantially elliptical shape with a major axis parallel to the longitudinal axis of the mass of explosive, a concave outer surface and a convex inner surface.

10. The mine of claim 9 wherein the safe and arm device includes a detonator disposed at one of a top center of the warhead or a bottom center of the warhead and electrically connected to the safe and arm device.

11. The mine of claim 10 wherein the computer comprises:

means for storing acoustic signatures of target vehicles;

means for comparing the stored acoustic signatures to sensed acoustic signatures; and means for determining if the sensed acoustic signature corresponds to a tracked or wheeled vehicle.

12. The mine of claim 11 wherein the computer comprises:

means for determining when the signal from the magnetometer has reached a maximum; and means for sending a detonate signal to the fuze electronics when the magnetometer signal has reached the maximum and the acoustic sensor detects one of a tracked and wheeled vehicle.

13. The mine of claim 12 wherein the fuze electronics detonates the bounding charge and then, after a preset time delay, detonates the warhead.

14. The mine of claim 13 wherein the fuze electronics detonates the warhead via the fuze cord that terminates at about a longitudinal midpoint of the warhead, if the target is classified as a tracked vehicle.

15. The mine of claim 14 wherein the fuze electronics detonates the warhead at one of the top center of the warhead or the bottom center of the warhead, if the target is classified as a wheeled vehicle.

16. The mine of claim 15 wherein the fuze electronics includes a self-destruct timer that is remotely settable via the radio.

17. The mine of claim 16 wherein the safe and arm device is remotely operable via the radio.

18. The mine of claim 17 wherein a number of asymmetric explosively forged penetrators is sixteen.

19. The mine of claim 18 wherein a number of erection legs is eight.

* * * * *